US012523109B2

(12) United States Patent
Smith

(10) Patent No.: US 12,523,109 B2
(45) Date of Patent: Jan. 13, 2026

(54) CASING CUTTING APPARATUS AND METHODS OF USE

(71) Applicant: Clear Choice Energy Services Ltd., Calgary (CA)

(72) Inventor: Troy Smith, Calgary (CA)

(73) Assignee: Clear Choice Energy Services Ltd., Calgary (CA)

( * ) Notice: Subject to any disclaimer, the term of this patent is extended or adjusted under 35 U.S.C. 154(b) by 0 days.

(21) Appl. No.: 18/316,684

(22) Filed: May 12, 2023

(65) Prior Publication Data

US 2023/0366285 A1 Nov. 16, 2023

Related U.S. Application Data

(60) Provisional application No. 63/341,077, filed on May 12, 2022.

(51) Int. Cl.
*E21B 31/16* (2006.01)

(52) U.S. Cl.
CPC ..... *E21B 31/16* (2013.01)

(58) Field of Classification Search
CPC ..... E21B 31/16; E21B 29/005
See application file for complete search history.

(56) References Cited

U.S. PATENT DOCUMENTS

| | | | | |
|---|---|---|---|---|
| 7,909,100 | B2 * | 3/2011 | Bryant, Jr. | E21B 29/005 175/269 |
| 2008/0156494 | A1 * | 7/2008 | Abadie | E21B 29/00 166/55 |
| 2019/0390530 | A1 * | 12/2019 | Telfer | E21B 47/10 |
| 2021/0355778 | A1 * | 11/2021 | Kristiansen | E21B 31/20 |

* cited by examiner

*Primary Examiner* — Nicole Coy
*Assistant Examiner* — Nicholas D Wlodarski
(74) *Attorney, Agent, or Firm* — Holzer Patel Drennan

(57) ABSTRACT

An improved casing cutter apparatus and method of use are provided for cutting one or more casing strings positioned within a subterranean wellbore during the 'cut-and-cap' stage of the wellbore abandonment process. In some embodiments, the apparatus may comprise a cutting attachment operably coupled to at least one mobile power source located at or near the surface of the wellbore.

9 Claims, 8 Drawing Sheets

CASING CUTTING APPARATUS AND METHODS OF USE

CROSS-REFERENCE TO RELATED APPLICATIONS

The present application claims priority to U.S. provisional patent application No. 63/341,077 entitled "CASING CUTTING APPARATUS AND METHODS OF USE," and filed on May 12, 2022, which is hereby incorporated by reference for all that it discloses or teaches

FIELD

Embodiments herein are generally related to an improved apparatus and method of use for cutting one or more casing strings positioned within a subterranean wellbore during the 'cut-and-cap' stage of the wellbore abandonment process.

BACKGROUND

Casing cutter tools used to cut off sections of wellbore casing strings, liners, and other tubular components positioned within a wellbore are well known in the oil and gas industry. Casing cutoff is important during any action that requires severing sections of the tubing within the wellbore, such as salvage operations, fishing operations, and certain production operations. Casing cutoff is also required when the wellbore is no longer needed and is being permanently sealed, including during the "cut-and-cap" stage of the well abandonment process in which the uppermost section of the wellbore casing is severed from downhole sections and removed from the ground, typically to prevent interference with ground-level operations including agriculture.

Known casing cutters for deep wellbore operations (i.e., not cut-and-cap operations) comprise several cutting blades, which can be reinforced with tungsten carbide, pivotally mounted on a rotatable tool body. As the tool rotates, the cutting blades gradually deploy outwardly, extending out from the tool to cut or mill through the inner periphery of the casing. Cutters can be pivotally mounted to the tool body and extended outwardly by various means including by hydraulic pressure (e.g., drilling fluid/mud flowing through a bore in the tool). Most commonly, and certainly most preferably, the casing is cut from the inside of the string by attaching a cutting tool to the end of a work string and running it down into the casing annulus.

For example, as described in U.S. Pat. No. 5,150,755, known casing cutters are threadably engaged to the drill string and run downhole to the desired depth where the cutting is to take place. Due to size restrictions within the wellbore, however, known casing cutters must comprise a reduced diameter, particularly where stabilizer fins are required, presenting significant challenges. The cutting stage of the cut-and-cap process can be further complicated by the fact that the various casings often are not situated concentrically to each other, but often are instead displaced and are eccentrically nested.

In the cut-and-cap process, it is operators are typically only required to cut each casing strings at or near the surface, e.g., at a minimum of 1-2 meters below surface (or such other depth as determined by regional energy regulations). Known cutters are powered by stationary drilling rigs, are designed with high tolerances and expensive materials to resist downhole conditions including the need for reduced diameters and are often included with extensive downhole componentry. Such known cutters are thus too expensive, large, and cumbersome for cut-and-cap processes and are not desirable for use without a stationary drilling rig (which are typically dismantled long before cut-and-cap operations are desired).

Therefore, there is a need for a transportable, mobile yet robust, surface-powered casing cutter tool operative to cut through more than one casing string, such an improved tool being useful for cut-and-cap well abandonment processes.

SUMMARY OF INVENTION

According to embodiments, an improved casing cutter attachment and methods of use for cutting at least one casing string in a subterranean wellbore are provided. In some embodiments, the casing cutter attachment may be operably connected to a mobile power source configured to both position the attachment within, and to rotate the attachment about, the inner annulus of at least one casing string. The attachment may comprise a tubular housing having an uphole end, a downhole end, a sidewall having a substantially circular cross section, and a bottom wall, and may form at least one fluid chamber in fluid communication with the power source. The attachment may further comprise at least one piston, moveably positioned within the at least one fluid chamber, and at least one cutting element contained within the housing and, when actuated by the at least one piston, pivotable between a first retracted position and a second extended position, wherein fluid pressure differentials within the at least one fluid chamber causes axial movement of the at least one hydraulic piston, pivoting the at least one cutting element from a first retracted position to a second extended position, and rotation of the attachment and causes the at least one cutting element to cut the at least one casing string.

In some embodiments, the casing cutter attachment may be releasably connected to the mobile power source, such releasable attachment comprising a pin connection.

According to embodiments, methods of using an improved casing cutting attachment to cut at least one casing string in a subterranean wellbore, are provided. In some embodiments, the methods may comprise providing a mobile power source, providing a casing cutting attachment and operatively coupling the attachment to the mobile power source, wherein the attachment may comprise a tubular housing forming at least one fluid chamber in fluid communication with the power source, at least one hydraulically actuated piston slidably positioned with the fluid chamber, and at least one cutting element pivotally contained withing the housing. In some embodiments, the cutting elements may be pivotable between a first retracted position and a second extended position, and the methods comprise operating the power source to insert the attachment in a first retracted position into the at least one casing string to a target depth, to inject hydraulic fluid into the at least one fluid chamber actuating movement of the at least one piston, causing the at least one cutting elements to pivot radially outwardly into a second extended position engaging with an inner surface of the at least one casing string, and then to rotate the attachment to cut the at least one cutting string.

In some embodiments, the at least one casing string may comprise at least two casing strings. In other embodiments, the at least two casing strings are cut in series.

In some embodiments, the methods may further comprise operating the power source to withdraw the attachment from the wellbore. In other embodiments, the methods may further comprise detaching the attachment from the power source.

BRIEF DESCRIPTION OF THE DRAWINGS

Embodiments of a casing cutting apparatus and methods of use are described herein having reference to the following FIGS. 1-8.

DETAILED DESCRIPTION OF THE PREFERRED EMBODIMENTS

According to embodiments, an improved cutting apparatus and methods of use for cutting one or more casing strings positioned within a subterranean formation are provided. In some embodiments, the present apparatus may be used to cut through at least one or more casing string(s) during the 'cut-and-cap' stage of the wellbore abandonment process. The present apparatus and methods of use may comprise a simple, yet robust, casing cutter attachment operably connected to a mobile unit (e.g., a backhoe, or the like), the mobile unit serving to both position the cutting attachment within the casing string(s) and to power the attachment to cut the one or more string(s) simultaneously (i.e., during one run) at or near the surface of the wellbore during cut-and-cap processes. Advantageously, the present apparatus may comprise an independent plug-and-play attachment that can be used with multiple types of power sources located near the surface of the wellbore during the cut-and-cap process.

Herein, the terms "above/below", "upper/lower", "uphole/downhole", and other terms of reference are used for ease of understanding and are generally intended to mean the relative uphole and downhole from surface/ground level. Similarly, the terms "horizontal" and "vertical" are used for ease of understanding and are generally intended to mean orientation relative the longitudinal axis of the wellbore positioned within a subterranean formation in the oil and gas industry.

Herein, the term "casing" and "casing string" are used for ease of understanding and are generally intended to mean at least one downhole tubular positioned within a subterranean wellbore in the oil and gas industry. Without limitation, the terms may include conductor casing, surface casing, intermediate casing, casing liner, and/or production casing, tubing string, liner, and the like.

Herein, the term "apparatus" and "attachment" are used interchangeably to describe the present invention.

The present apparatus and methods of use will now be described in more detail having regard to FIGS. 1-8.

Figure 1:
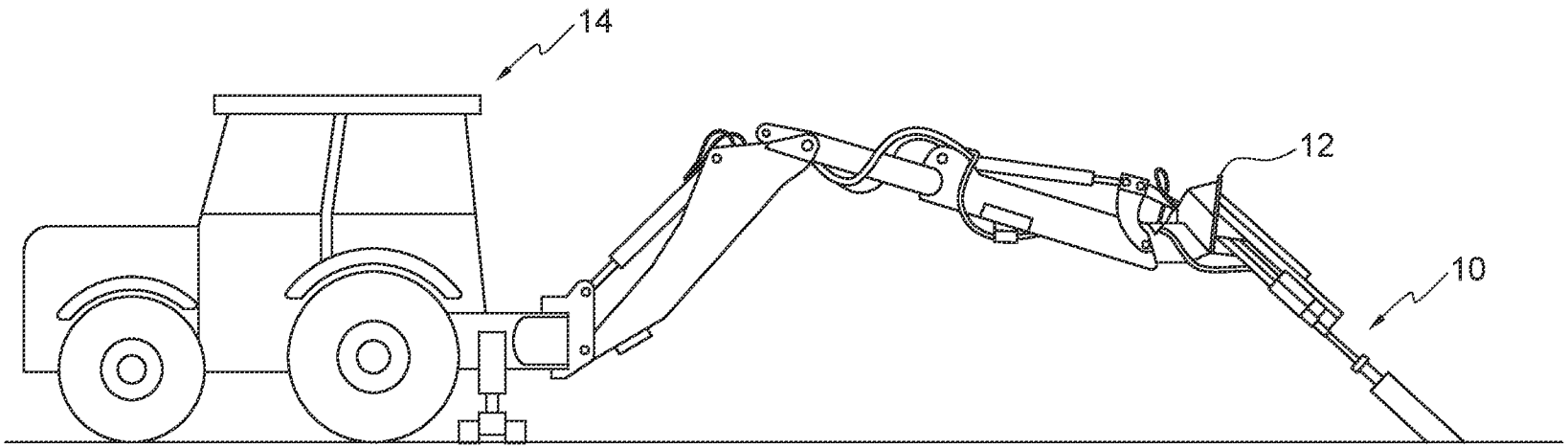
FIG. 1 shows a perspective side view of the present apparatus, the apparatus being operably connected to a mobile hydraulic power source (e.g., conventional construction equipment), according to embodiments.

According to embodiments, having regard to FIG. 1, the present apparatus 10 may be operably coupled to at least one power source 12 for activating and powering apparatus 10. Power source 12 may comprise at least one mobile piece of machinery or equipment positioned at or near the surface of the subterranean wellbore. In some embodiments, power source 12 serves to both position apparatus 10 within, and to rotate apparatus 10 about, the central bore (annulus) of at least one casing string(s) for cutting of the string(s) (not shown).

In some embodiments, power source 12 may be any suitable mobile machinery or equipment, the source being suitably sized, shaped, and configured for an operator to readily position and control the operation of apparatus 10 using said mobile equipment. Power source 12 may comprise both an electrical and a hydraulic fluid power source including, without limitation, hydraulic power means derived from an excavator, picker truck, backhoe, bobcat, tractor, or the like. Although power source 12 is primarily described as comprising hydraulic fluid, any other suitable power source including, without limitation, mechanical, pneumatic, electrical and the like are contemplated.

In some embodiments, apparatus 10 may be operably connected to power source 12 such that power source 12 may be used to insert apparatus 10 into the wellbore to the target depth (where cutting is to occur), and then to operate apparatus 10 to cut the at least one casing string. Apparatus 10 may be lowered into the wellbore in a first retracted position (FIG. 3A) to a depth at or near the target location within the at least one casing string. Once in position, power source 12 may be used to introduce hydraulic fluids directly from power source 12, under pressure, into apparatus 10 until fluid pressures within apparatus 10 are sufficient to extend pivotable cutting elements outwardly from the apparatus 10 (into a second extended position; FIG. 3B) and into contact with the inner surface of the casing string. Power source 12 may also be used to rotate attachment 10 (e.g., clockwise about longitudinal axis x) to cut the at least one casing strings. Advantageously, attachment 10 may be configured to be releasably connected to any suitable power source, providing a simply, effective and powerful casing cutter tool.

In some embodiments, apparatus 10 may be operably connected to power source 12 so as to supply pressurized hydraulic fluid directly from source 12 to attachment 10. For example, apparatus 10 may be connected via at least one swivel, or any other mechanism for conducting fluid between power source 12 and attachment 10 and for rotating attachment 10. In some embodiments, swivel may configured to comprise at least one bearing assembly positioned about attachment 10 allowing rotation of apparatus 10 within the stationary swivel. Although any swivel operative to achieve the desired result is contemplated, in some embodiments, swivel may comprise a side-port or side-entry swivel 33 in fluid communication with bore 22, wherein pressurized fluids from power source 12 enter swivel, via a fluid inlet, and flow through a fluid passageway into bore 22.

As will be described, it is an advantage that apparatus 10 may comprise an independent, separate, attachment tool or device for operably connecting to any power source 12. For example, apparatus 10 may comprise a plug-and-play attachment tool configured to be operably connected to mobile equipment (e.g., construction equipment 14; see FIG. 1) such that, when attached, apparatus 10 may be readily positioned within the at least one casing string(s) in the wellbore, and easily raised/lowered to the appropriate target location for cutting thereof (e.g., during the cut-and-cap stage of the wellbore abandonment processes). Once in position, apparatus 10 may be rotated about its longitudinal axis (e.g., via construction equipment, such as motor/swivel of excavator) causing casing cutters to extend from the body of the apparatus 10 to cut the one more casing string(s). In this manner, apparatus 10 may be readily maneuvered between a first retracted position when run inhole and a second extended position when cutting the at least one casing string(s).

Figure 2:
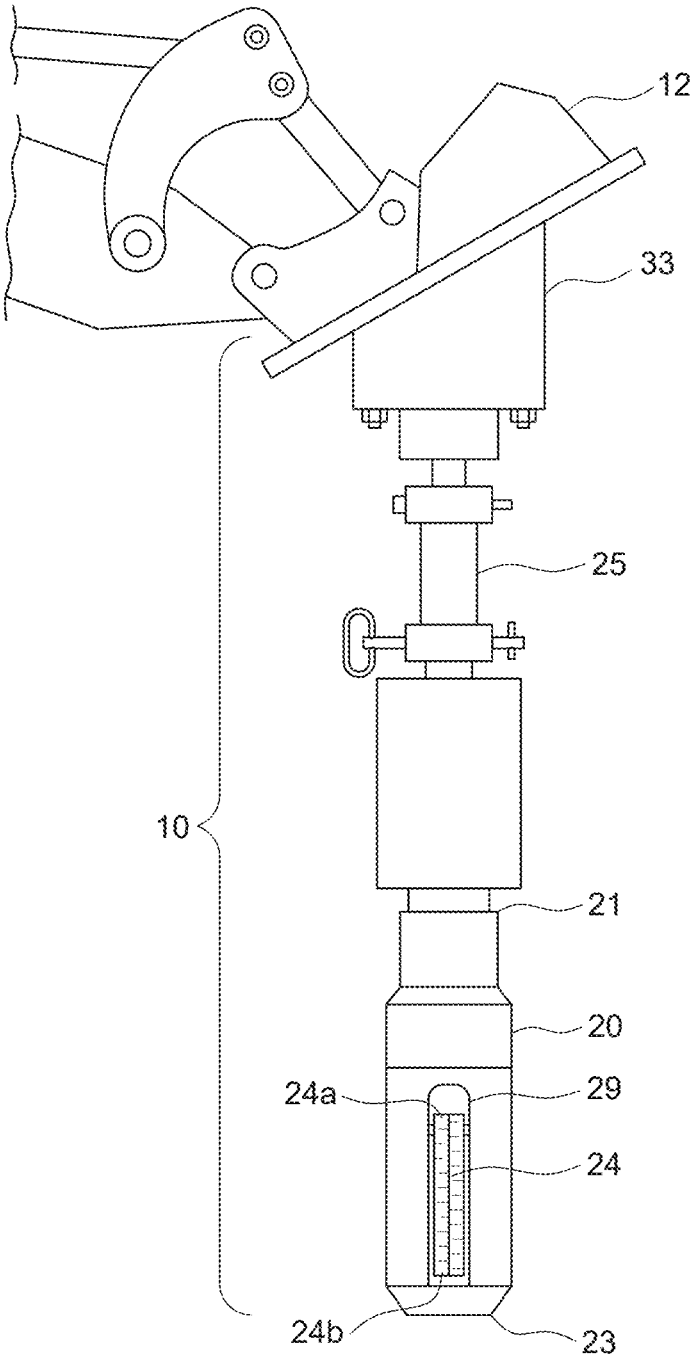
FIG. 2 shows a zoomed-in side view of the apparatus operably attached to the power source shown in FIG. 1, according to embodiments.

According to embodiments, having regard to FIG. 2, attachment 10 may comprise an elongate body having a substantially cylindrical tubular housing 20. In some embodiments, attachment 10 may have a smaller outer diameter than the inner diameter of the smallest casing string(s), such that, when in a first retracted position, apparatus 10 may be slidably inserted into the smallest casing string. Housing 20 may form a single tubular housing, or may form a plurality of tubulars 20*a*,20*b* (see FIG. 4) operably connected end-to-end (e.g., by threaded engagement).

In some embodiments, housing 20 may be configured for releasable connection to power source 12, i.e., via any suitable coupling (e.g., pin connection), mechanical coupler, snap-fit engagement, threaded connection, or the like. In some embodiments, housing 20 may comprise be configured for rotatable connection to power source 12, i.e., via shaft 25 operably coupled to rotatable element of excavator (e.g., swivel, auger driver, or other known motor/rotation means). In this manner, activation the excavator's swivel serves to rotate housing 20 of attachment 10 (e.g., in either a clockwise or counterclockwise direction). For clarity, the term "operably coupled" means that attachment 10 may be directly connected to power source 12 or that they may be coupled to each other through one or more further components and through this direct connection power source 12 serves to power a given function (e.g., rotation) of attachment 10.

Figure 4:
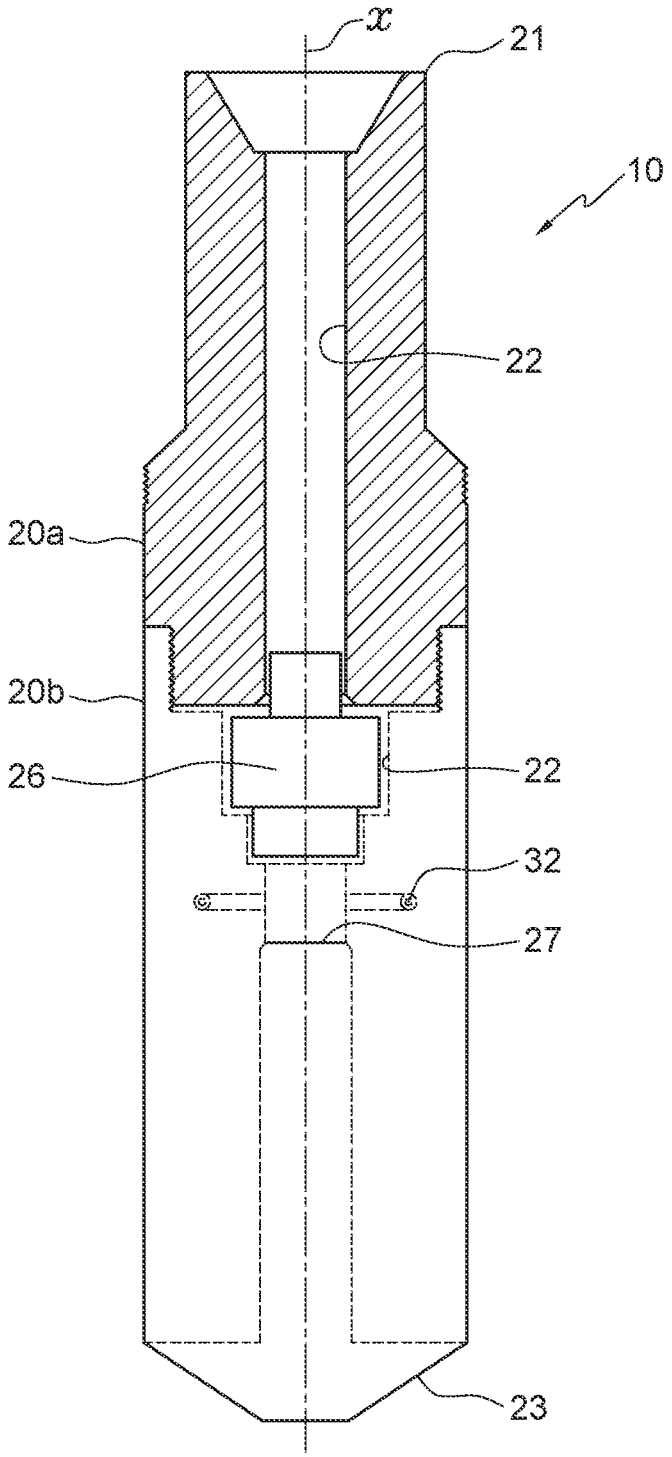
FIG. 4 shows a cross-sectional side view of the apparatus attachment of FIG. 2, according to embodiments.

According to embodiments, housing 20 may have an uphole end 21, a downhole end 23, and may form at least one internal fluid chamber 22 extending from uphole end 21 into housing 20 (see FIG. 4), e.g., along longitudinal axis x (see FIG. 4). In some embodiments, fluid chamber 22 may form a central housing bore comprising varying internal diameters, and a bottom wall 27. Fluid chamber 22 may be in fluid communication with power source 12 such that chamber 22 forms a contained fluid chamber within housing 20 for receiving fluid from power source 12 (whereby fluid pressures within chamber 22 can be controllably changed to hydraulically actuate at least one piston 26, as will be described). For example, having regard to FIG. 4, in some embodiments, fluid chamber 22 may be any size, shape, and configuration for slidably retaining at least one hydraulic piston 26 therein, and for receiving and containing hydraulic fluid from power source 12, whereby changes in hydraulic fluid pressures within fluid chamber 22 serve to controllably actuate the at least one piston 26 within chamber 22.

According to embodiments, as above, fluid chamber 22 may be in fluid communication with one or more hydraulic fluid sources (e.g., hydraulic oil) from power source 12 at surface. In some embodiments, fluid chamber 22 may be configured in any manner so as to operably receive and controllably retain hydraulic fluid introduced into the chamber from power source 12. For example, chamber 22 may be in fluid communication with power source 12 (at surface), such that hydraulic fluid (e.g., hydraulic oil) from power source 12 may be controllably introduced into chamber 22 via uphole end 21 of housing 20, causing fluid pressures within chamber 22 to increase. Increasing fluid pressures within chamber 22 serves to controllably actuate at least one hydraulic piston 26, triggering axial translation (uphole/downhole movement) thereof within chamber 22. As the at least one piston 26 travels downhole within chamber 22, pistons 26 contact at least one cutting element 24 housed within housing 20 and cause the cutting elements 24 to pivot/extend from the first retracted position (FIG. 3A) to the second extended/cutting position (FIG. 3B). It is understood that, although hydraulically activated pistons 26 are described herein, any suitably configured fluid pressure responsive elements serving to maneuver the at least one cutting element(s) 24 are contemplated.

According to embodiments, housing 20 may form at least one longitudinally extending slot 29 extending through sidewall. In some embodiments, housing 20 may for a plurality of longitudinally extending slots 29 circumferentially spaced about the periphery of housing 22, slots 29 being sized and shaped for allowing movement of cutters 24 therethrough. In some embodiments, slots 29 may be substantially rectangular in shape, extending longitudinally through housing 20 sidewall parallel with longitudinal axis x.

According to embodiments, at or near its downhole end, housing 20 may contain at least one cutting element(s) 24. Cutting element(s) 24 may be housed within housing 20 such that when apparatus 10 is run inhole, cutting element(s) 24 are retained in a retracted position (allowing apparatus 10 to readily slide within the at least one casing string(s) without interference). Cutting element(s) 24 may be pivotally housed within housing 20 such that when apparatus 10 is rotated (e.g., clockwise when viewed top down from surface), cutting element(s) 24 pivot outwardly from housing 20 (e.g., through corresponding slots 29 in housing sidewall) into an extended position (causing cutting element(s) 24 to engage and cut the sidewall of the at least one casing string(s) from the inside).

Figure 3A:
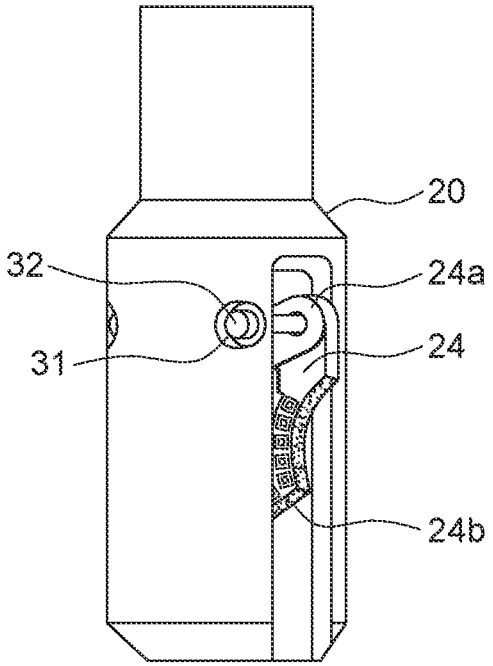
FIGS. 3A and 3B show zoomed-in side views of the apparatus attachment of FIG. 2 shown in isolation, FIG. 3A showing a first retracted position (cutting elements positioned within apparatus) and FIG. 3B showing a second extended position (cutting elements positioned extended from apparatus), FIGS. 3A and 3B being collectively referred to herein as FIG. 3, according to embodiments.
Figure 3B:
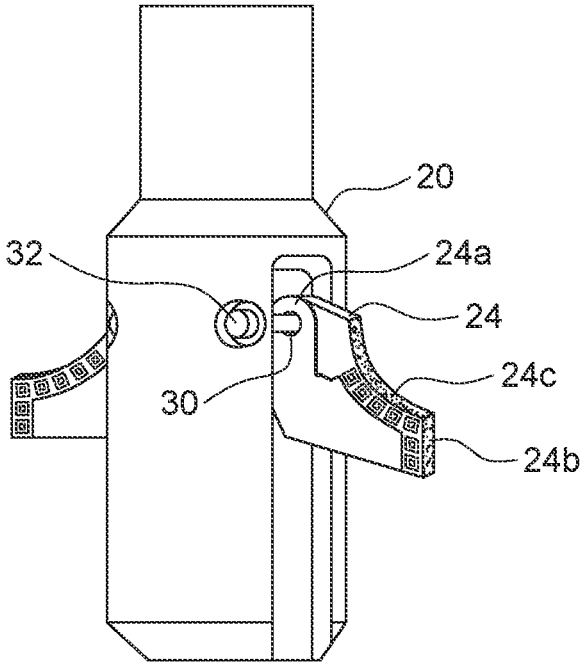
Figure 5:
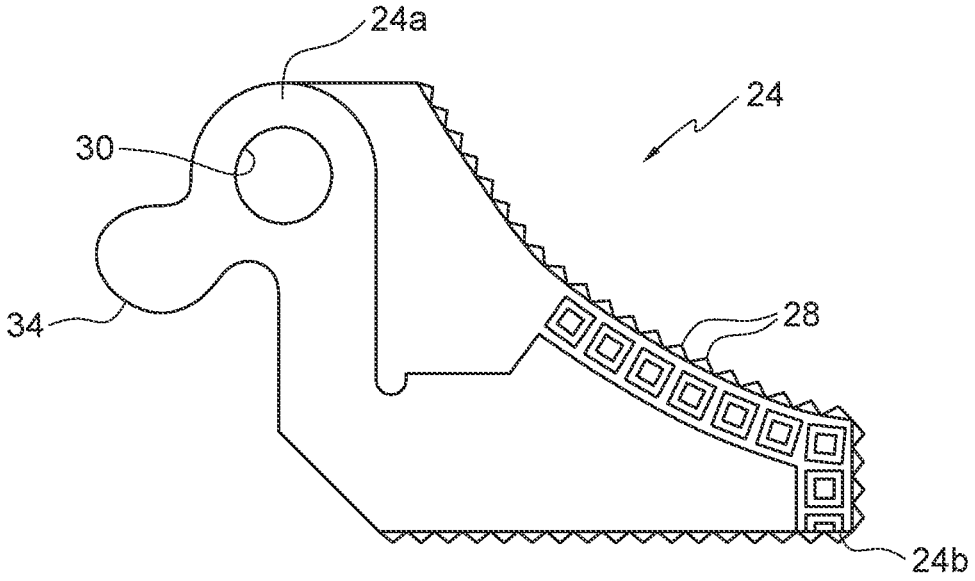
FIG. 5 shows a zoomed-in side view of at least one cutting element of the apparatus shown in FIG. 2, according to embodiments.
Figure 6A:
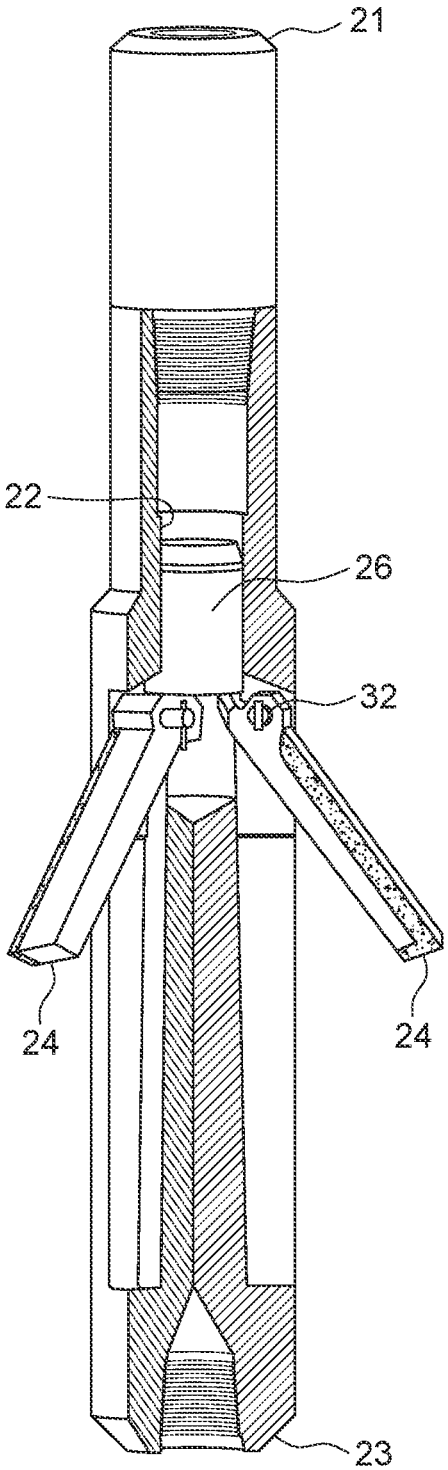
FIG. 6 shows partial cross-sectional side views of the apparatus shown in FIG. 2 in the second extended position, FIG. 6A showing a first embodiment of the apparatus and FIG. 6B showing a second embodiment of the apparatus, according to embodiments.
Figure 6B:
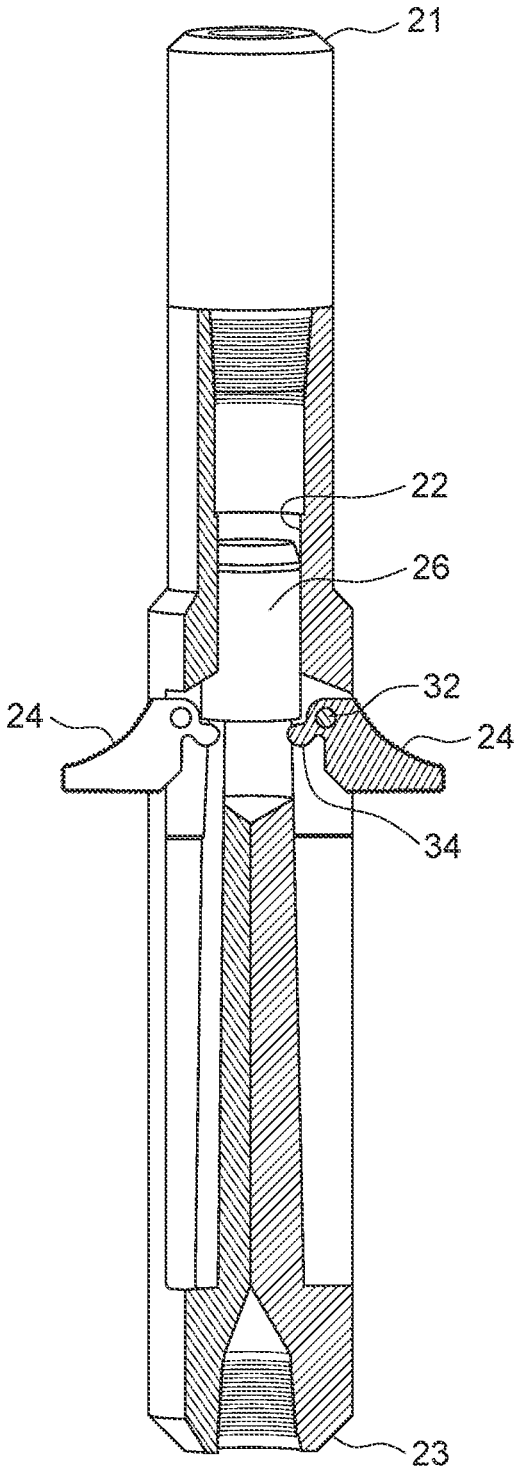
Figure 8:
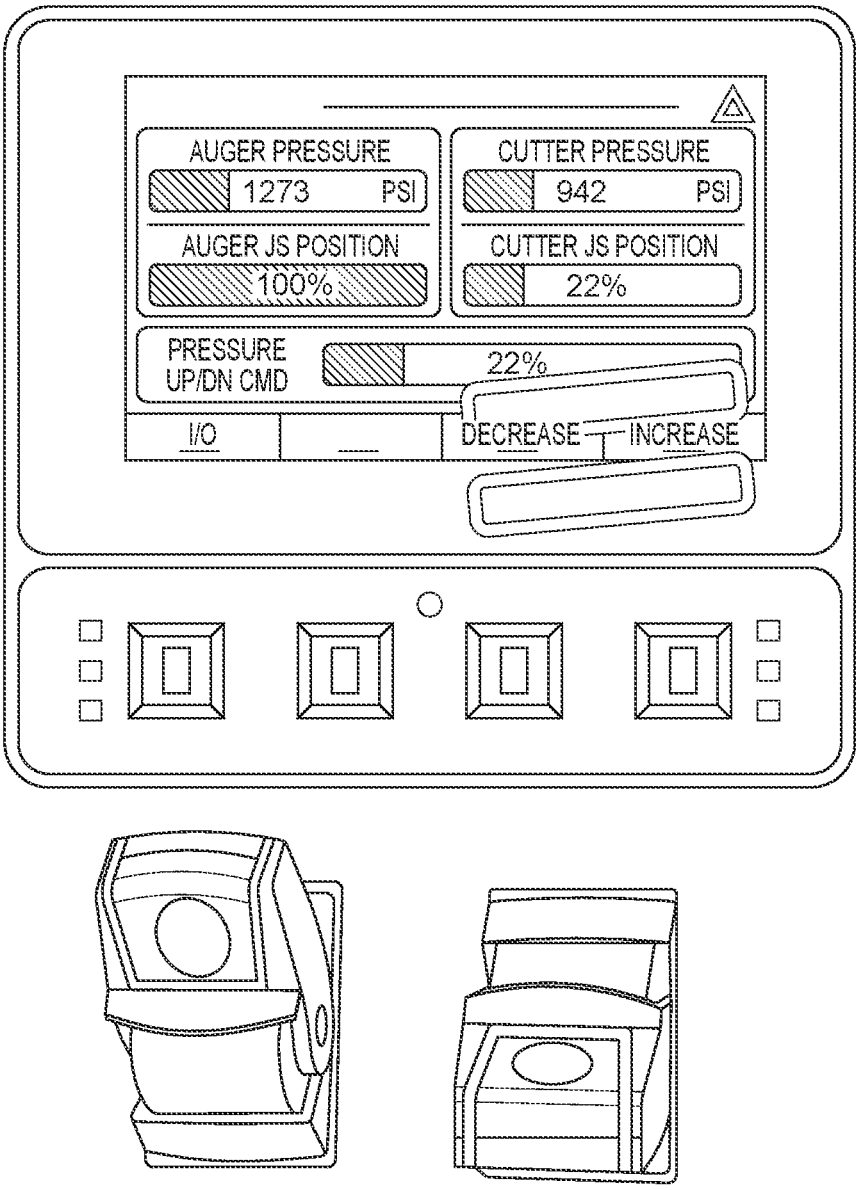
FIG. 8 shows a top perspective view of a control system operatively connected to the apparatus shown in FIG. 2, according to embodiments.

More specifically, having regard to FIG. 3A, FIG. 3B and FIG. 5, when apparatus 10 is run inhole without rotation of the apparatus 10, the at least one cutting element(s) 24 may be retained within housing 20 (e.g., first retracted position; FIG. 3A). Then, when in position at or near the target location of the at least one casing string being cut, hydraulic fluid may be introduced to fluid chamber 22, actuating the at least one hydraulic piston 26 and pivoting the at least one cutting elements 24 (as described above) from within housing 20 through corresponding slot 29 to a (radially) extended position (e.g., second extended position; FIG. 3B), and apparatus 10 may be rotated about its central longitudinal axis x to cause the at least one cutting element(s) 24 to cut at least one casing string. As above, both hydraulic actuation of pistons 26 and rotation of apparatus 10 may be controlled by power source 12 at or near the surface using manual or automatic controls, or a combination thereof (FIG. 8). Advantageously, operator may readily utilize a control system integrated into or retrofit into mobile power source 12 in order to control the speed and/or direction of rotation of the attachment 10 during cutting, as well as to adjust the positioning of attachment 10 within the wellbore in real time.

According to embodiments, the at least one piston 26 may be configured to be slidably received within attachment 10 and more specifically within fluid chamber 22. In some embodiments, piston 26 may be substantially cylindrical in shape, having a sidewall slidingly engaged within inner surface of chamber 22 and, at its uphole end, a piston area where forces imparted by pressurized fluids act engage movement of piston 26.

In some embodiments, having regard to FIG. 5, the at least one cutting element(s) 24 may form an internal (fulcrum) end 24*a*, an external (cutting) end 24*b*, and a sidewall 24*c* (FIG. 3B). Internal end 24*a* may be configured for mounting on a pin mounted within housing 20 at or near an uphole end of slot 29 (e.g., housing 20 may form a pin hole or groove 31 for receiving and supporting pin). In some embodiments, internal end 24*a* may form aperture 30 for slidably receiving pin 32. A tang or extension 34 extends upwardly from internal end 24*a*. For moving external cutting end 24*b* of cutting elements 24 radially outwardly (through slots 29) into the second expanded cutting position with the casing string, the operator may simply activate the power source 12 to inject hydraulic fluid into the at least fluid chamber 22. Once a predetermined fluid pressure differential is reached (above and below the piston 26), the piston 26 moves downwardly contacting tangs 34 to pivot the at least one cutting element(s) 24 outwardly, radially through slots 29 into cutting engagement with the casing string. When the at least one cutting element(s) 24 are pivoted outwardly to the second radially extended position in contact with the casing string, a decreased fluid pressure differential is detected at the power source 12, informing the operator that the cutting elements 24 are extended and in cutting engagement with the casing string.

In some embodiments, the at least one cutting element(s) 24 are free for pivoting between the first retracted position and the second extended (cutting) position. In this manner, the length of the at least one cutting element(s) 24 may be any predetermined size, as desired, depending upon the number and spacing of the at least one casing string(s) being cut. Advantageously, the present attachment may be used to cut a single casing string(s), or to cut a plurality of concentric casing string(s) in a single trip.

According to embodiments, having regard to FIG. 5, the at least one cutting elements 24 may be configured to receive a plurality of cutting blades 28 mounted thereon. In some embodiments, blades 28 may be mounted along the entire sidewall of the cutting elements 24. Blades 28 may be manufactured from materials and by methods commonly employed in the manufacture of oil well tools in general and casing cutters in particular. In some embodiments, blades 28 may be machined from high yield steel, treated with heat or other processes to harden and temper the blades, and provided with tungsten carbide dressing or inserts on the cutting surfaces thereof. In some embodiments, blades 28 and/or cutting element(s) 24 may be manufactured from tungsten carbide. Although one embodiment of cutting element(s) 24 having a plurality of blades 28 mounted thereon is provided, any suitable size, shape, and configuration of cutting element(s) 24 and blades 28 are contemplated.

Figure 7A:
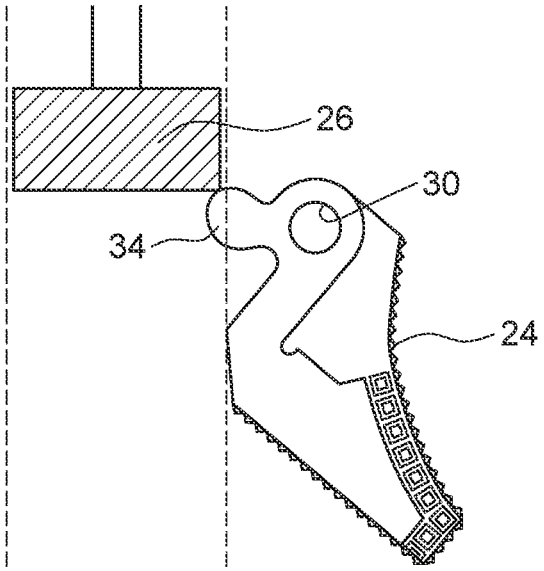
FIG. 7 shows zoomed-in cross-sectional side views of cutting elements of the present apparatus, FIG. 7A showing the cutting element partially extended from the apparatus and FIG. 7B showing the cutting element fully extended from the apparatus, according to embodiments.
Figure 7B:
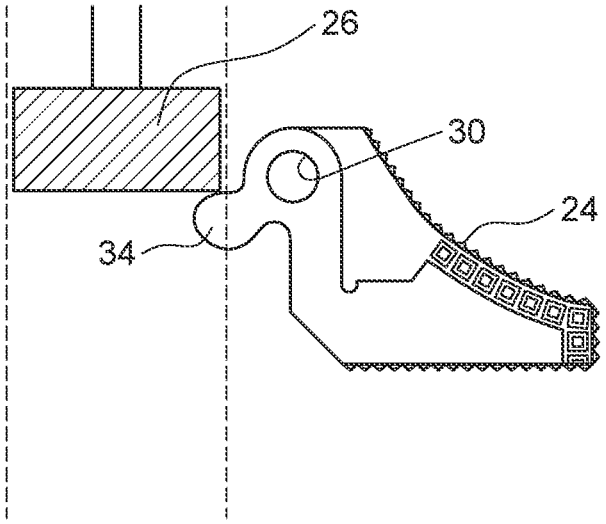

According to embodiments, methods of using a casing cutter attachment 10 are provided, the methods comprising operably coupling the attachment 10 to a mobile power source 12 on surface and operating the power source 12 to insert the attachment 10 to the target cutting location within at least one casing string being cut. Once in position, power source 12 may be used to both direct hydraulic fluids under pressure from the source 12 into at least one contained fluid chamber 22 within attachment 10, actuating hydraulic pistons positioned within chamber 22 to cause the pivotable extension of at least one cutting element(s) 24, and to simultaneously rotate attachment 10 about its longitudinal axis x. In their expanded position, the radially extended at least one cutting element(s) come into cutting contact with the inner surface of the at least one cutting string(s) being cut. The pivotal connections between the at least one cutting element(s) 24 and the peripheral surface of each of the casing string(s) as they are being cut is sufficient to transmit the torque required to accomplish the cutting of a plurality of casing string(s) in series (i.e., concentrically from the most internal casing string to the most external casing string). For example, when the cutting methods are commenced, cutting element(s) 24 may extend radially outwardly until contact with the inner surface of the first casing to be cut it made (FIG. 7A). Once the first casing string is cut, cutting element(s) 24 may then extend further outwardly to contact the inner surface of the second casing to be cut (FIG. 7B), and so on, until all desired casing strings are cut. As cutting continues, operator may controllably adjust pressures within bore 22 (e.g., according to sensor readings provided at control panel, see FIG. 8, e.g., from pressure sensors, gauges, and the like) to increase and/or decrease cutting power to cutting element(s) 26 (i.e., via fluid pressures imposed upon pistons 26). For example, where more cutting force is needed to simultaneously cut through more than one casing, hydraulic pressures within bore 22 and thus power to the cutting element(s) 24 may be increased, enabling apparatus 10 to cut through a plurality of casing strings even when said strings are not centralized within wellbore. Where less cutting force is needed, hydraulic pressures within bore 22 may simply be decreased. Advantageously, apparatus 10 eliminates the need for the continuous flow of fluids, such as drilling fluids through the tool. Apparatus 10 need not be connected to drill string or other downhole equipment.

More specifically, according to embodiments, methods of cutting at least one casing string, and preferably a plurality of casing strings in series, in a subterranean wellbore are provided. In some embodiments, the method comprises providing a mobile power source 12 at or near the surface of the wellbore, and operatively coupling a casing cutter attachment 10 to the power source 12. Herein, "operatively coupled" means both in hydraulic fluid communication and in electrical communication therewith.

In some embodiments, once attached, the power source 12 may be used to insert the attachment 10 described herein into the wellbore to the desired, target depth where cutting of the casing string is to occur. Once lowered to the target depth, the power source 12 may be operated to deliver hydraulic fluid under pressure to the at least one fluid chamber of attachment 10, actuating the at least one hydraulic piston slidably positioned therein, and causing the at least one cutting element(s) 24 to extend from the first retracted position (stored within housing 20) to the second extended position for cutting. Simultaneously, the power source 12 may also be used to rotate the attachment to cut the at least one cutting string. Advantageously, the present attachment 10 may be of sufficient power and torque to cut through a plurality of casing strings in series, i.e., in one run.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

I claim:

1. A casing cutter attachment for cutting at least two casing strings in a subterranean wellbore, the attachment releasably connected to a mobile power source configured to both position the attachment within, and to rotate the attachment about, the annulus of the at least two casing strings, the attachment comprising:

a tubular body having an uphole end, a downhole end, a sidewall having a substantially circular cross section, and a bottom wall, the tubular body having at least one internal fluid chamber forming a central bore in fluid communication with the mobile power source, and at its uphole end, at least one side-port swivel for releasable connection to the mobile power source, at least one hydraulic piston, moveably positioned within the at least one internal fluid chamber, at least one cutting element contained within the tubular body and, when actuated by the at least one hydraulic piston, pivotable between a first retracted position and a second extended position, wherein fluid pressure differentials within the at least one internal fluid chamber causes axial movement of the at least one hydraulic piston, pivoting the at least one cutting element from the first retracted position to the second extended position, and rotation of the attachment and causes the at least one cutting element to cut the at least two casing strings in series.

2. The attachment of claim 1, wherein, at the uphole end, the tubular body is releasably connected to the mobile power source.

3. The attachment of claim 1, wherein the sidewall of the tubular body forms at least one longitudinal slot for the at least one cutting element to pivotally extend therethrough.

4. The attachment of claim 1, wherein a plurality of blades are mounted on the at least one cutting element.

5. A method of cutting at least two casing strings in a subterranean wellbore, the method comprising:

providing a mobile power source;

providing a casing cutting attachment and releasably coupling, via a side-port swivel, the attachment to the mobile power source, the attachment having a tubular body at least one internal fluid chamber in fluid communication with the mobile power source, at least one hydraulically actuated piston slidably positioned within the at least one internal fluid chamber, and at least one cutting element pivotally contained within the tubular body, the at least one cutting element pivotable between a first retracted position and a second extended position, operating the mobile power source to insert the attachment in the first retracted position into one of the at least two casing strings to a target depth, to inject hydraulic fluid into the at least one internal fluid chamber for receiving and containing fluid from the mobile power source to controllably actuate movement of the at least one hydraulically actuated piston, causing the at least one cutting elements to pivot radially outwardly into the second extended position engaging with an inner surface of one of the at least two casing strings, and to rotate the attachment to cut the at least two cutting strings in series.

6. The method of claim 5, wherein the method further comprises operating the mobile power source to withdraw the attachment from the wellbore.

7. The method of claim 6, wherein the method further comprises detaching the attachment from the mobile power source.

8. The method of claim 5, wherein the mobile power source comprises mobile equipment or machinery at or near the surface of the subterranean wellbore.

9. The method of claim 8, wherein the mobile power source comprises mobile construction equipment.

* * * * *